US009127577B2

(12) United States Patent
Donald

(10) Patent No.: US 9,127,577 B2
(45) Date of Patent: Sep. 8, 2015

(54) PACKING LUBRICATION SYSTEM

(75) Inventor: Steven T. Donald, Agua Dulce, TX (US)

(73) Assignee: Dixie Iron Works, LTD, Alice, TX (US)

( * ) Notice: Subject to any disclaimer, the term of this patent is extended or adjusted under 35 U.S.C. 154(b) by 361 days.

(21) Appl. No.: 13/541,710

(22) Filed: Jul. 4, 2012

(65) Prior Publication Data

US 2014/0010670 A1 Jan. 9, 2014

Related U.S. Application Data

(60) Provisional application No. 61/504,658, filed on Jul. 5, 2011.

(51) Int. Cl.

| | |
|---|---|
| ***F01M 1/04*** | (2006.01) |
| ***F04B 39/02*** | (2006.01) |
| ***F04B 53/18*** | (2006.01) |
| ***F04B 53/02*** | (2006.01) |
| ***F04B 53/14*** | (2006.01) |

(52) U.S. Cl.

CPC ..... *F01M 1/04* (2013.01); *F04B 39/0207* (2013.01); *F04B 53/02* (2013.01); *F04B 53/146* (2013.01); *F04B 53/18* (2013.01)

(58) Field of Classification Search

CPC ... F04B 39/027; F04C 29/0014; F04C 29/025

USPC ..... 417/273, 568, 228; 184/1.5, 6.8, 6.7, 184/6.28, 6.1, 5.1, 7.3, 6.14, 27.1; 92/153, 92/156, 158; 277/510–511, 534–541

See application file for complete search history.

(56) References Cited

U.S. PATENT DOCUMENTS

| | | | | |
|---|---|---|---|---|
| 1,397,548 | A * | 11/1921 | Ripley | 184/27.1 |
| 3,232,379 | A * | 2/1966 | Mueller et al. | 184/6.8 |
| 3,351,156 | A * | 11/1967 | Cook et al. | 184/6.8 |
| 4,186,654 | A | 2/1980 | Scott | |
| 5,125,480 | A * | 6/1992 | Gregory et al. | 184/6.26 |
| 5,209,495 | A * | 5/1993 | Palmour | 277/500 |
| 2005/0200081 | A1 * | 9/2005 | Stanton et al. | 277/510 |
| 2006/0231341 | A1 | 10/2006 | Wech | |
| 2006/0289237 | A1 | 12/2006 | Beauchamp | |

OTHER PUBLICATIONS

Oil-Rite Corporation, PurgeX, Catalogue, pp. 1-20, Manitowoc, WI 54221, www.oilrite.com.

* cited by examiner

*Primary Examiner* — Charles Freay
*Assistant Examiner* — Kenneth J Hansen
(74) *Attorney, Agent, or Firm* — Winstead PC

(57) ABSTRACT

A positive displacement packing lubrication system where the lubrication rate is mechanically determined via power take-off from the lubricated equipment.

15 Claims, 4 Drawing Sheets

PACKING LUBRICATION SYSTEM

RELATED APPLICATIONS

This application claims the benefit of U.S. provisional application No. 61/504,658 filed on Jul. 5, 2011, entitled A Non-Electric, Positive Displacement Packing Lubrication System, the disclosure of which is incorporated by reference herein.

BACKGROUND

This section provides background information to facilitate a better understanding of the various aspects of the disclosure. It should be understood that the statements in this section of this document are to be read in this light, and not as admissions of prior art.

In the oil industry it is common to utilize multiplex pumps to deliver fluid at high pressures. A common multiplex pump is a triplex pump having a three pumping units. Each pumping unit includes a plunger that reciprocates through a stuffing box comprising a packing gland. It is common for the packing gland seals to be continuously lubricated to ensure a low friction surface at the seal and to provide cooling of the seals to extend the life of the seals. Continuous lubrication of the packing glands is a simple and reliable method of lubricating packing glands, in particular for oil field multiplex pump operation.

SUMMARY

A packing lubrication system in accordance with one or more embodiments includes a device having a plunger reciprocally moveable through a packing in response to rotation of a crankshaft, a positive displacement pump in fluid communication between the packing and a lubricant at a prime pressure, the positive displacement pump discharging a volume of the lubricant to the packing in response to an actuating pressure; and a control valve operationally connected between the crankshaft and the positive displacement pump, the control valve intermittently applying the actuating pressure to the positive displacement pump in response to rotation of the crankshaft.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

Embodiments of packing lubrication systems are described with reference to the following figures. It is emphasized that, in accordance with standard practice in the industry, various features are not necessarily drawn to scale. In fact, the dimensions of various features may be arbitrarily increased or reduced for clarity of discussion.

DETAILED DESCRIPTON

Figure 1:
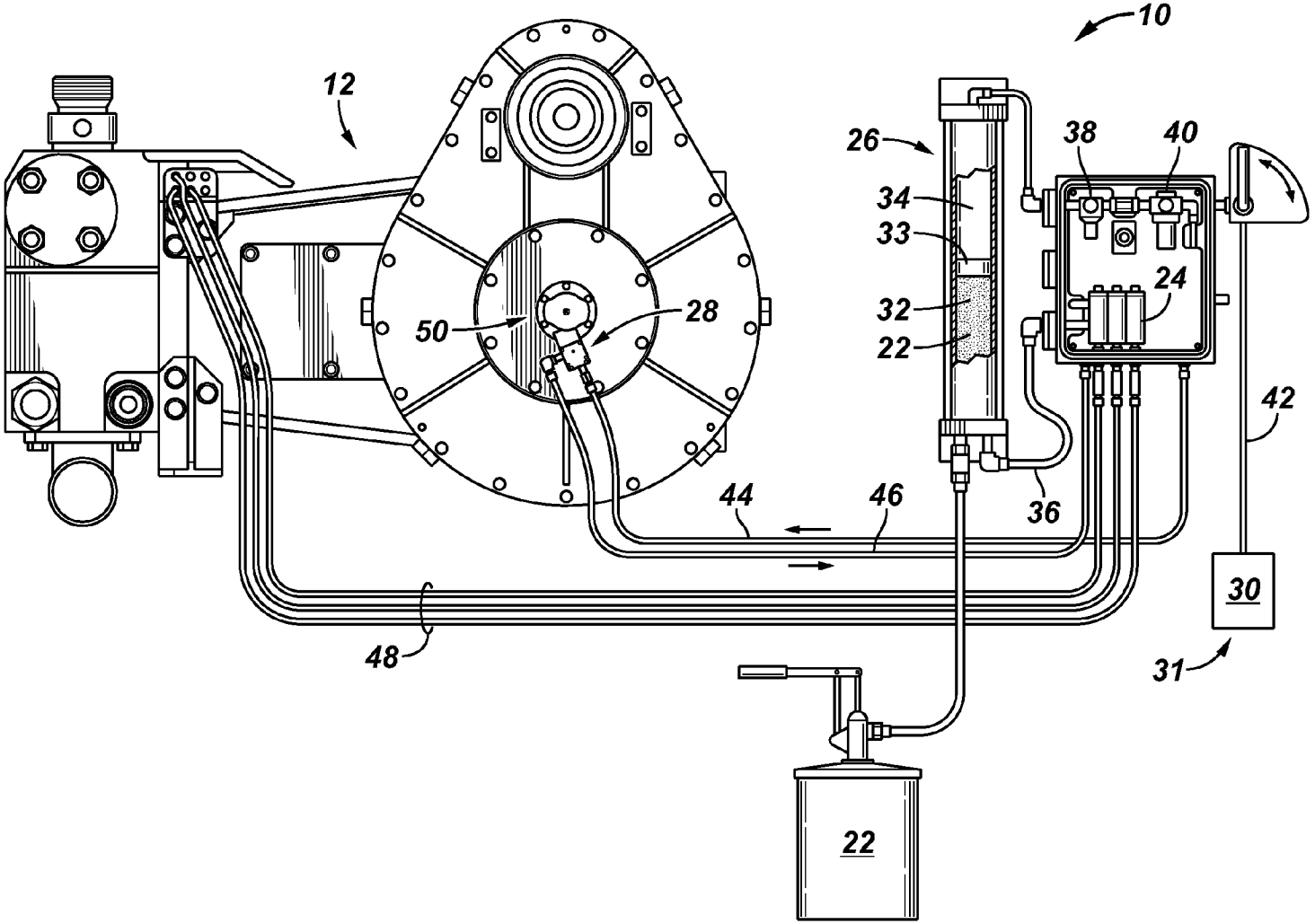
FIG. 1 illustrates an example of a packing lubrication system according to one or more embodiments.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Figure 2:
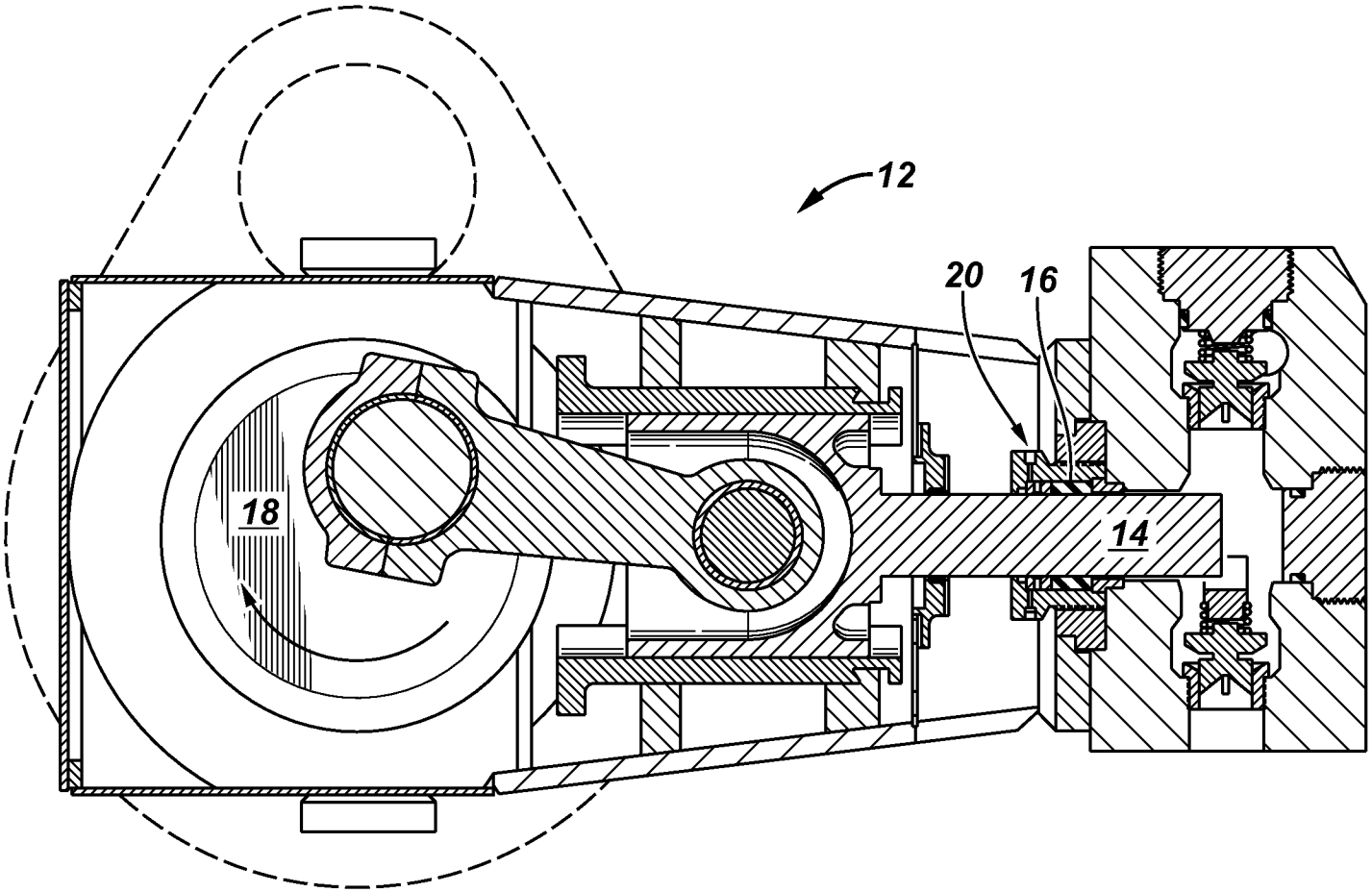
FIG. 2 illustrates an example plunger pump in which embodiments of the packing lubrication system can be implemented.

FIG. 1 schematically illustrates an example of a packing lubrication system, generally denoted by the numeral 10, according to one or more embodiments. FIG. 1 depicts packing lubrication system 10 implemented with a pump 12, referred to herein as a plunger pump (e.g., multiplex pump). As depicted in FIG. 2, pump 12 includes a member, plunger 14, that reciprocates through a seal, referred to herein as packing 16 (e.g., packing gland), in response to the rotating movement of crankshaft 18. Lubricant is provided to packing 16 through a port 20. Packing lubrication system 10 can be utilized with any equipment wherein a rotating member drives a reciprocating member through a packing. The lubrication rate is mechanically controlled by the lubricated pump by a power take-off ("PTO") from the crankshaft of the pump 12. Controlling the rate of lubrication and/or the volume of lubricant supplied can minimize over and under lubricating and ensure that the seals are lubricated when the pump is in operation. The embodiment illustrated in FIG. 1 is non-electric for use in explosive environments.

Referring in particular to FIGS. 1 and 2, packing lubrication system 10 is adapted for installation with a pump 12 to provide a lubricant 22, for example grease or oil, to packing 16. According to embodiments, packing lubrication system 10 is adapted to utilize a grease lubricant 22. Examples of lubricant 22 include greases, such as a water-resistant, non-soap, NLGI Grade 2 plating grease for operating temperatures between −18 degree F. and 400 degree F. Other examples include greases that meet NLGI standards for Grades 000, 00, 0, 1, and 2. Examples of oil lubricants include rock drill oils and conventional motor oils.

Packing lubrication system 10 comprises a positive displacement pump, referred to herein as PD pump 24, fluidicly connected between a pressurized lubricant reservoir 26 and packing 16 of pump 12, and a control valve 28 (e.g., solenoid, switch) operationally connected between the crankshaft 18 (FIG. 2) of pump 12 and PD pump 24 to control the displacement of lubricant 22 by PD pump 24. In the example depicted in FIG. 1, pump 12 is a triplex pump having three reciprocating plungers 14 and three respective packings 16 to be lubricated. In the depicted embodiment, packing lubrication system 10 provides a PD pump 24 for each packing 16 to be lubricated. However, it is recognized that a PD pump 24 may provide lubricant 22 to one or more packings 16 (i.e., seals).

Embodiments of packing lubrication system and method 10 are now described with reference to FIGS. 1-5. In the depicted embodiments, PD pumps 24 are powered and actuated by pneumatic pressure 30 from an air supply 31 (e.g., compressor). Pneumatic pressure 30 is applied in parallel to a lubricant priming circuit to supply lubricant 22 at a constant pressure, referred to as a prime pressure, to PD pump 24, and to an actuating circuit to actuate PD pump 24 to discharge lubricant 22 to packing 16 at the prime pressure. The rate at which lubricant 22 is discharged is determined by the speed of rotation of the pump crankshaft 18.

Referring first to the lubricant priming circuit, lubricant 22 is supplied (i.e., plumbed) to PD pump 24 from lubricant reservoir 26, which is an air over lubricant reservoir assembly in this embodiment. Lubricant reservoir 26 comprises a lubricant chamber 32 and an air chamber 34 separated by a piston 33. Lubricant 22 is disposed in lubricant chamber 32 which is in fluid communication with PD pump 24 through a prime conduit 36. Pneumatic pressure 30 is supplied through a first pressure regulator 38 to air chamber 34. First pressure regulator 38 is utilized to apply a constant, or prime pressure, via piston 33 to lubricant 22. Lubricant 22 is supplied from lubricant reservoir 26 to PD pump 24 at the constant prime pressure. The prime pressure is the pressure at which lubricant 22 is supplied to packing 16. Prime pressure as utilized herein includes a pressure range including any pressure losses occurring between lubricant reservoir 26 to the injection of lubricant 22 at packing 16. It is noted that PD pump 24 will stroke only once in response to positive air pressure and PD pump 24 will not continuously stroke when supplied with constant pressure. PD pump 24 strokes discharging a volume of lubricant 22 in response to an actuating pressure greater than the prime pressure that is intermittently applied from control valve 28 to PD pump 24.

Referring to the pneumatic actuating circuit, pneumatic pressure 30 is routed from air supply 31 to a second pressure regulator 40 via supply conduit 42. Pneumatic pressure 30 is supplied from second pressure regulator 40 at an actuating pressure to control valve 28 through control conduit 44. The actuating pressure is greater than the prime pressure. In response to actuating control valve 28 open (i.e., on) the actuating pressure is applied via return conduit 46 to PD pump 24. In response to the application of the intermittent actuating pressure above the constant prime pressure, PD pump 24 discharges (e.g., injects) a volume of lubricant 22, at the prime pressure, through lubricant conduit 48 to packing 16. The volume of lubricant 22 discharged from PD pump 24 per stroke of PD pump 24 can be adjusted for the particular application as the rate at which the lubricant is discharged.

According to one or more embodiments, the prime pressure is less than the actuating pressure provided through second regulator 40. For example, lubricant 22 may be supplied to PD pump 24 by first pressure regulator 38 at a constant prime pressure of about 60 psig and the actuating pressure at second pressure regulator 40 may be at about 80 psig to 100 psig. The higher actuating pressure actuates PD pump 24 over the constant prime pressure supplied to PD pump 24.

Figure 4:
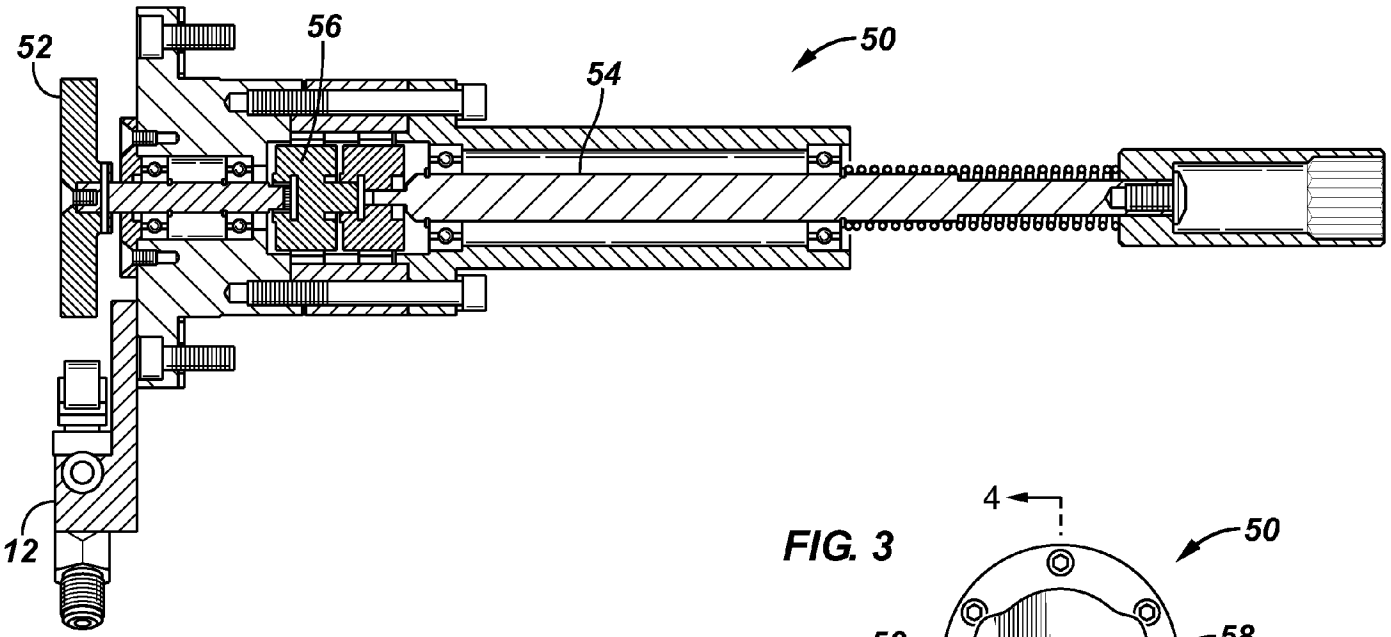
FIG. 4 illustrates a gearbox assembly along an line 4-4 of FIG. 3 in accordance to an embodiment of a packing lubrication system.
Figure 3:
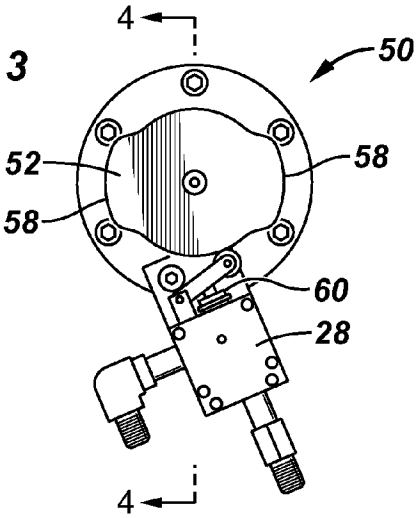
FIG. 3 illustrates a control valve operationally connected to a gearbox assembly in accordance with an embodiment of a packing lubrication system.
Figure 5:
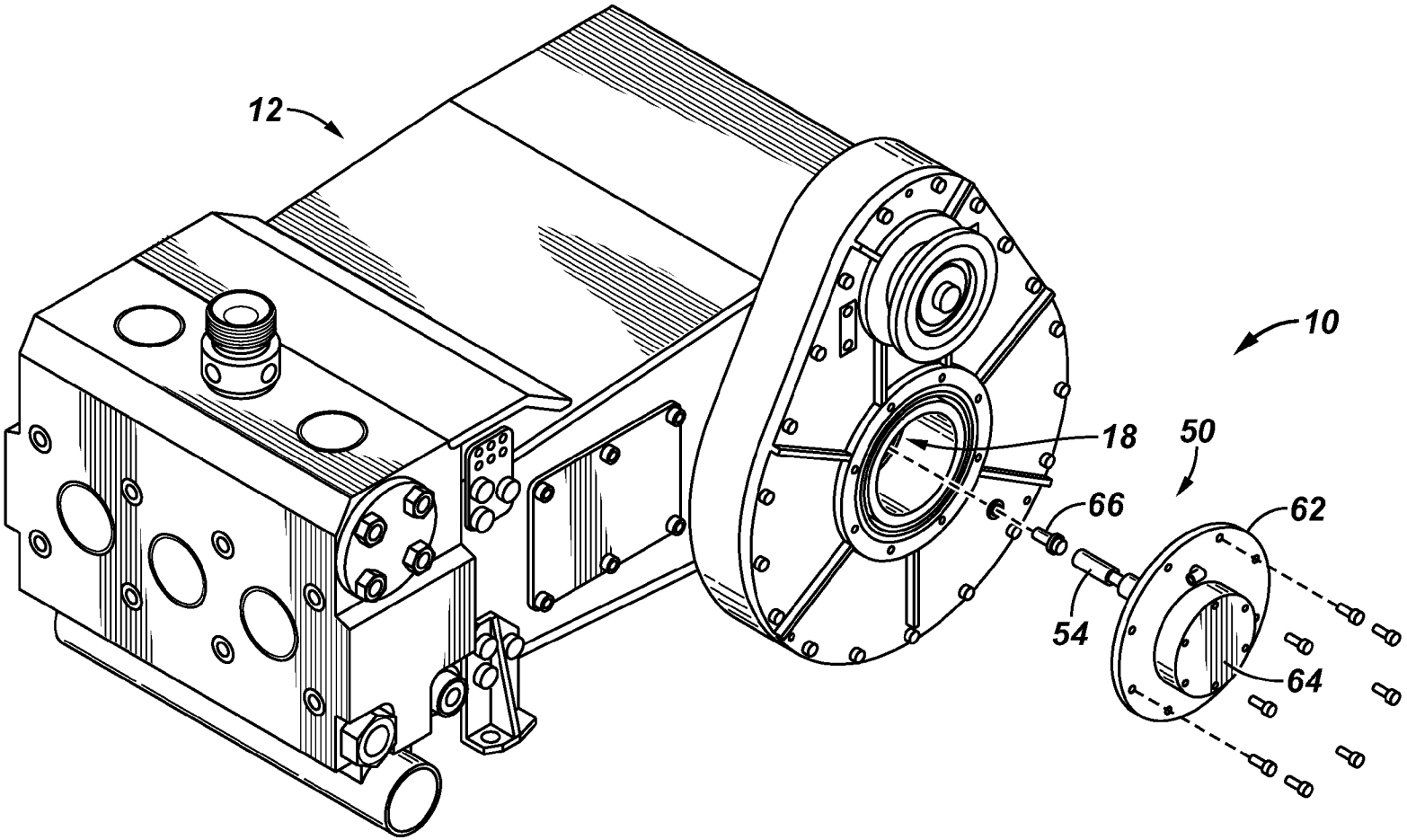
FIG. 5 illustrates an example of a gearbox assembly positioned for connection with a rotating member of a pump in accordance with an embodiment of a packing lubrication system.

The operational connection of control valve 28 to pump 12 is now described with reference to the embodiments depicted in particular in FIGS. 3 to 5. Control valve 28, for example a three-way normally closed valve, is operationally connected to crankshaft 18 (e.g., rotating member) via an assembly 50. Assembly 50, e.g., gearbox assembly, comprises a cam 52 and a camshaft 54 adapted to be connected to crankshaft 18 of pump 12. When assembly 50 is installed in pump 12, rotation of crankshaft 18 rotates camshaft 54 and cam 52. According to some embodiments, assembly 50 includes a reducer 56 connecting cam 52 and camshaft 54 to reduce the speed of rotation of cam 52 relative to the speed of rotation of crankshaft 18. Assembly 50 is illustrated in FIG. 5 positioned for connection to crankshaft 18 of pump 12 with a bolt 66. Assembly 50 is depicted in FIG. 5 attached to the bearing plate 62 of pump 12 and a cover 64 positioned over control valve 28.

Referring again to FIGS. 1 to 5, the PD pump 24 will only stroke once in response to positive pneumatic pressure and to complete a cycle of PD pump 24 the pneumatic supply is cycled on and off to reset PD pump 24. The rotation of cam 52 in response to the rotation of crankshaft 18 causes control valve 28 to cycle on (i.e., open) and off (i.e., closed) as lobe 58 of cam 52 depresses a piston 60 of control valve 28. When control valve 28 cycles on, i.e., open, the actuating pressure supplied via control conduit 44 passes through control valve 28 and is applied to PD pump 24 via return conduit 46. The positive pressure of the actuating pressure above the prime pressure causes PD pump 24 to stroke and discharge a volume of lubricant 22 through lubricant conduit 48 to packing 16. According to one or more embodiments, the volume of lubricant 22 discharged on each stroke, or cycle, of PD pump 24 is predetermined. In one example, PD pump 24 discharges a constant volume of lubricant 22, for example 0.00036 cubic inches, per stroke of PD pump 24. The lubrication rate is determined by the speed at which the lubricated pump 12 is operating. Additionally, a reducer 56 may be selected to further adjust the frequency at which PD pump 24 is actuated. It is again note that packing lubrication system 10 may include a PD pump 24 for each lubricated packing 16.

The foregoing outlines features of several embodiments of packing lubrication systems and methods so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A packing lubrication system, the system comprising:

a device having a plunger reciprocally moveable through a packing in response to rotation of a crankshaft;

a positive displacement pump in fluid communication between the packing and a lubricant at a prime pressure, the positive displacement pump discharging a volume of the lubricant at the prime pressure to the packing in response to an actuating pressure;

a control valve operationally connected between the crankshaft and the positive displacement pump, the control valve intermittently applying the actuating pressure to the positive displacement pump in response to rotation of the crankshaft;

a pneumatic pressure source in communication with a lubricant reservoir through a first pressure regulator; and the pneumatic pressure source in communication with the control valve through a second pressure regulator, wherein the first pressure regulator supplies the pneumatic pressure at the prime pressure to the lubricant and the second pressure regulator supplies the pneumatic pressure at the actuating pressure.

2. The system of claim 1, wherein the lubricant is a grease.

3. The system of claim 1, wherein the actuating pressure is greater than the prime pressure.

4. The system of claim 1, further comprising an assembly connected between the control valve and the crankshaft, the assembly comprising a camshaft connected to the crankshaft and a cam connected to the camshaft.

5. The system of claim 1, wherein the lubricant is grease.

6. The system of claim 1, wherein the actuating pressure is greater than the prime pressure.

7. The system of claim 1, further comprising an assembly connected between the control valve and the crankshaft, the assembly comprising a camshaft connected to the crankshaft and a cam connected to the camshaft.

8. The system of claim 7, wherein the actuating pressure is greater than the prime pressure.

9. The system of claim 8, wherein the lubricant is a grease.

10. A method for lubricating a packing of multiplex pump, comprising:

supplying a lubricant from a lubricant reservoir at a prime pressure to a positive displacement pump;

intermittently applying an actuating pressure greater than the prime pressure to the positive displacement pump in response to rotation of a crankshaft of the multiplex pump;

intermittently discharging a volume of the lubricant from the positive displacement pump at the prime pressure to the packing in response to the actuating pressure;

supplying the prime pressure from a pneumatic pressure source to the lubricant reservoir;

supplying the actuating pressure from the pneumatic pressure source to a control valve operationally connected to the crankshaft of the multiplex pump; and intermittently opening the control valve thereby applying the actuating pressure to the positive displacement pump.

11. The method of claim 10, wherein the actuating pressure is applied to the positive displacement pump in response to opening a control valve operationally connected to the crankshaft of the multiplex pump.

12. The method of claim 11, comprising an assembly connecting the control valve to the crankshaft of the multiplex pump, the assembly comprising a camshaft connected to the crankshaft and a cam connected to the camshaft.

13. The method of claim 10, wherein the prime pressure is about 60 psi.

14. The method of claim 10, wherein the lubricant is grease.

15. The method of claim 10, wherein the prime pressure of the lubricant supplied to the positive displacement pump and discharged from the positive displacement pump is about 60 psi.

* * * * *